US006759609B1

(12) United States Patent
Henderson et al.

(10) Patent No.: US 6,759,609 B1
(45) Date of Patent: Jul. 6, 2004

(54) LOCKOUT FOR A ROCKER SWITCH

(76) Inventors: Sharmaine Laura Lynn Henderson, PO Box 385, Kelowna, British Columbia (CA), V1Y 7N8; Lorne Monroe Henderson, PO Box 385, Kelowna, British Columbia (CA), V1Y 7N8

( * ) Notice: Subject to any disclaimer, the term of this patent is extended or adjusted under 35 U.S.C. 154(b) by 0 days.

(21) Appl. No.: 10/703,661

(22) Filed: Nov. 10, 2003

(51) Int. Cl.[7] ..... H01H 3/20; H01H 9/28

(52) U.S. Cl. ..... 200/43.11; 200/43.16; 200/321

(58) Field of Search ..... 200/43.01–43.22, 200/315, 316, 339, 553–564, 318–327

(56) References Cited

U.S. PATENT DOCUMENTS

| | | | | |
|---|---|---|---|---|
| 2,246,919 A | | 6/1941 | Krantz | |
| 2,789,170 A | | 4/1957 | Johnson | |
| 4,002,874 A | | 1/1977 | Brown | |
| 4,187,420 A | | 2/1980 | Piber | |
| 4,291,207 A | * | 9/1981 | Reinke et al. | 200/325 |
| 4,504,707 A | | 3/1985 | Ochiai | |
| 4,705,920 A | * | 11/1987 | Sahrbacker | 200/43.04 |
| 4,910,365 A | | 3/1990 | Kuo | |
| 5,047,598 A | | 9/1991 | Osika et al. | |
| D353,798 S | | 12/1994 | Bryde et al. | |
| 5,434,378 A | | 7/1995 | McLean | |
| 5,558,209 A | | 9/1996 | Mohsen | |
| 5,738,206 A | | 4/1998 | Souza | |
| 5,803,237 A | | 9/1998 | Gandre et al. | |
| 6,392,170 B1 | | 5/2002 | Wechsler | |
| 2001/0030114 A1 | | 10/2001 | Thielman | |

FOREIGN PATENT DOCUMENTS

EP 0 241 257 10/1987

OTHER PUBLICATIONS

Consumer Reports, Jan., 1997 Copyright 1997 Consumers Union of U.S., Inc. Section: vol. 62, No. 1;p. 29 (4th page–lines 30–36) Consumer Reports Jan., 1997.

* cited by examiner

*Primary Examiner*—James R. Scott
(74) *Attorney, Agent, or Firm*—Antony C. Edwards

(57) ABSTRACT

A switch lockout and rocker switch includes a switch cover, a rocker plate, a base, and a lockout slide. The rocker plate has opposite first and second ends, and is pivotally mounted to the cover. The rocker plate is thus pivotable about a pivot axis between oppositely tilted first and second tilted positions. The slide is selectively translatable relative to the base, being slidably mounted on the base for translation of the slide in a slide direction perpendicular to the pivot axis so as to slide relative to the rocker plate between a first lockout position and second lockout position.

12 Claims, 4 Drawing Sheets

LOCKOUT FOR A ROCKER SWITCH

FIELD OF THE INVENTION

This invention relates to the field of electrical switches generally, and in particular to a rocker switch and lockout for selectively, releasably locking out the operation of the rocker switch.

BACKGROUND OF THE INVENTION

In the prior art applicant is aware of U.S. Pat. No. 4,187,420 to Piber which discloses a rocker switch locking attachment having a sliding member. The sliding member has interference ear portions located at both ends of the sliding member and an aperture adapted to receive a rocker switch pivot shaft which locks the slider in either a leftmost or rightmost position. The Piber patent does not disclose nor suggest the use of a cover mounted slider locking system such as found in the present invention and set out below.

SUMMARY OF THE INVENTION

The present invention is a switch cover locking device for a toggle or rocker arm-type switch. The device includes a sliding locking arm. The sliding arm may be slid relative to the toggle switch so as to block and thereby to prevent the toggle or rocker arm switch, herein referred to generically as a rocker plate, from pivoting. A notched locking mechanism is adapted to receive a detent from the locking arm so as to lock the locking arm in either a forward, rearward, or neutral locked position.

In summary, the switch lockout and rocker switch of the present invention includes a switch cover, a rocker plate, a base, and a lockout slide. The rocker plate has opposite first and second ends, and is pivotally mounted to the cover. The rocker plate is thus pivotable about a pivot axis between oppositely tilted first and second tilted positions. The slide is selectively translatable relative to the base, being slidably mounted on the base for translation of the slide in a slide direction perpendicular to the pivot axis so as to slide relative to the rocker plate between a first lockout position and second lockout position.

The first end of the rocker plate is spaced from the base when the rocker plate is in the first tilted position. The second end of the rocker plate is spaced from the base when the rocker plate is in the second tilted position.

The lockout slide includes oppositely disposed first and second interference bars. The interference bars are slidable so as to a) sandwich the first interference bar between the first end of the rocker plate and the base when the lockout slide is in the first lockout position, and b) sandwich the second interference bar between the second end of the rocker plate and the base when the lockout slide is in the second lockout position.

The first interference bar thus protrudes into a path of motion of the first end of the rocker plate when in the first lockout position, and the second interference bar protrudes into a path of motion of the second end of the rocker plate when in the second lockout position. Thus, in the first lockout position, the first end of the rocker plate is selectively releasably locked into an elevated position relative to the base, and, in the second lockout position, the second end of the rocker plate is selectively releasably locked into an elevated position relative to the base.

Advantageously, the first and second interference bars are spaced apart a distance greater than the length of the rocker plate measured the entire length between the first and second ends of the rocker plate. The lockout slide is thus selectively translatable into either the first lockout position or the second the lockout position or a neutral position wherein neither the first nor the second interference bars are in their respective lockout positions and the rocker plate may be freely pivoted about the pivot axis.

In one embodiment the lockout slide may include a pair of elongate members extending in the slide direction oppositely disposed on either side of the rocker plate, opposite ends of the pair of elongate members rigidly mounted to corresponding ends of the first and second interference bars. Advantageously then the base extends around a circumferential edge of the cover so as to extend along either side of the rocker plate. A pair of guides are mounted to the base oppositely disposed on either side of rocker plate so as to guide the elongate members when sliding in the slide direction.

The cover has a primary aperture. The rocker plate is pivotally mounted in primary aperture. The cover has at least one slot therein adjacent the primary aperture and aligned both parallel to the slide direction and over a corresponding elongate member of the pair of elongate members when the cover is mounted on the base. At least one push button may be mounted onto the corresponding elongate member so as to extend from the elongate member through the corresponding slot. The slot is elongate parallel to the slide direction so that biasing the button along the slot to an end of the slot opposite from the first end of the rocker plate biases the first interference bar into the first lockout position. Conversely, biasing the button along the slot to an end of the slot opposite from the second end of the rocker plate biases the second interference bar into the second lockout position. A pair of such slots may be oppositely disposed on either side of the primary aperture, a pair of buttons mounted on the pair of elongate members so as to protrude through the pair of slots.

The elongate members may be elevated above the base by elevating means so as to elevate at least a portion of the elongate members adjacent the buttons above the base. The elongate members may be resiliently deflectable where so elevated so that the buttons may be depressed to thereby release a selectively releasable latch means for locking the lockout slide in the first lockout position or the neutral position or the second lockout position, so that the lockout slide may be selectively translated relative to the base. The elevating means may be shim means mounted between the lockout slide and the base, for example rigid shims mounted to the base. The shims may be at least a pair of shims at opposite ends of each of the elongate members so as to elevate substantially the entire length of the elongate members above the base.

The rocker plate may be pivotally mounted to the cover by at least one shaft member extending from the cover into the primary aperture. The primary aperture is sized to snugly receive the rocker plate therein, and the shaft member may be an opposed facing pair of stub shafts or pins.

The guides may be channels, each having therein an array of notches. The latch means may include a pin extending from each button so as to mate into a notch in the array of notches when the button is released and the elongate member urges the pin into engagement with a corresponding notch of the array of notches. Depressing the button drives the pin from the notch as the elongate member deflects towards the base, thereby allowing the sliding translation of the elongate member in the slide direction to align the pin with a different the notch in the array of notches.

DETAILED DESCRIPTION OF EMBODIMENTS OF THE INVENTION

Figure 1:
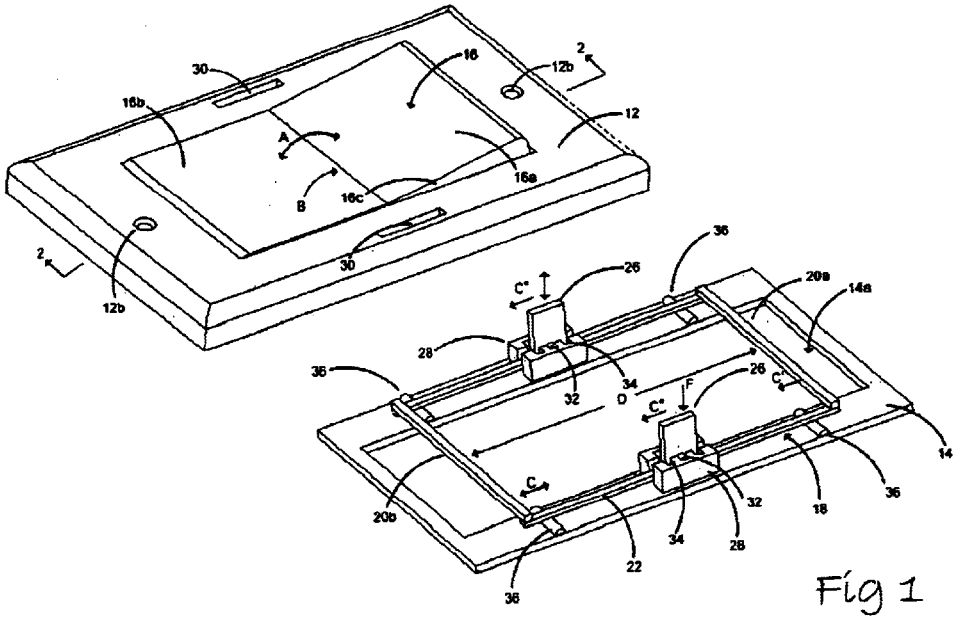
FIG. 1 is, in partially exploded perspective view, the rocker switch and lockout according to the present invention.
Figure 1A:
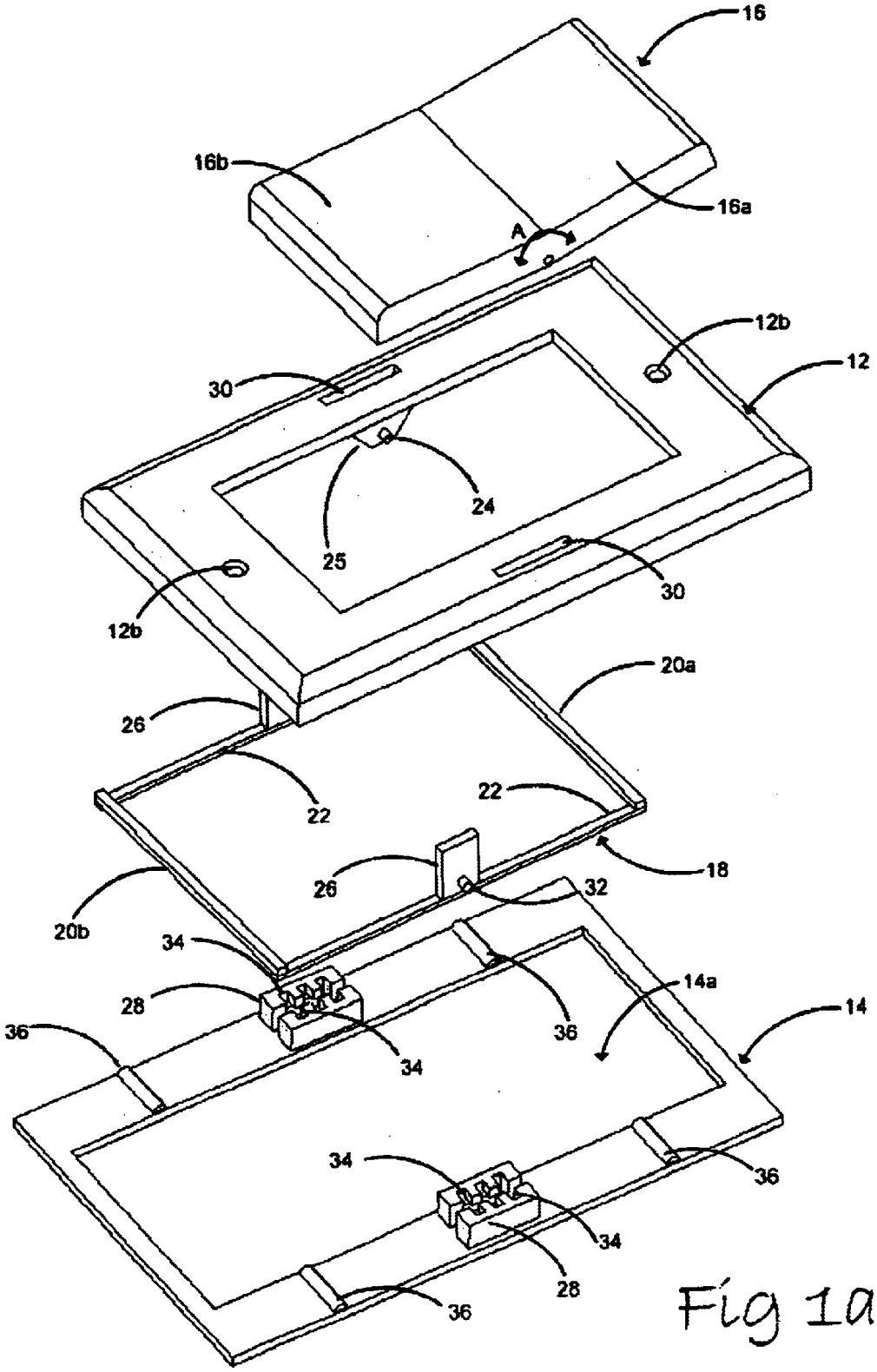
FIG. 1*a* is a fully exploded perspective view of an alternative embodiment of the rocker switch and lockout of the present invention.
Figure 2:
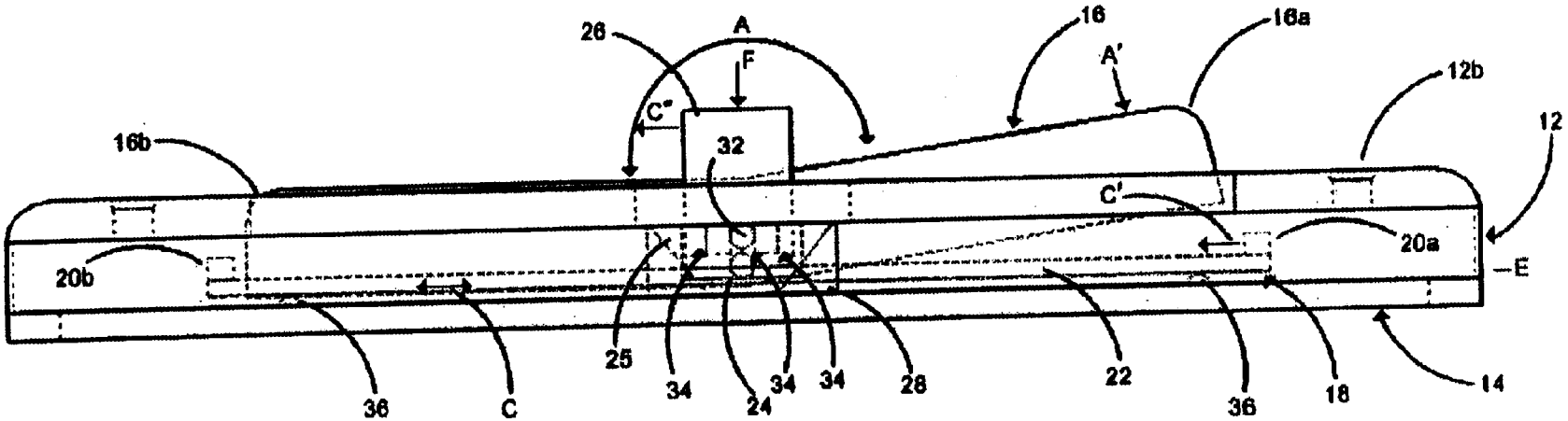
FIG. 2 is, in cross section in an unexploded view along 2—2 in FIG. 1.

As seen in the accompanying Figures wherein similar characters of reference denote corresponding parts in each view, the rocker switch and lockout according to the present invention includes a cover 12 which mounts over a base 14. A rocker plate 16 is pivotally mounted to cover 12 for rocking in direction A about pivot axis B. As seen in FIGS. 1 and 2, a lockout slide 18 is slidably mounted for translation in slide direction C on base 14 when cover 12 is mounted over base 14.

Figure 3:
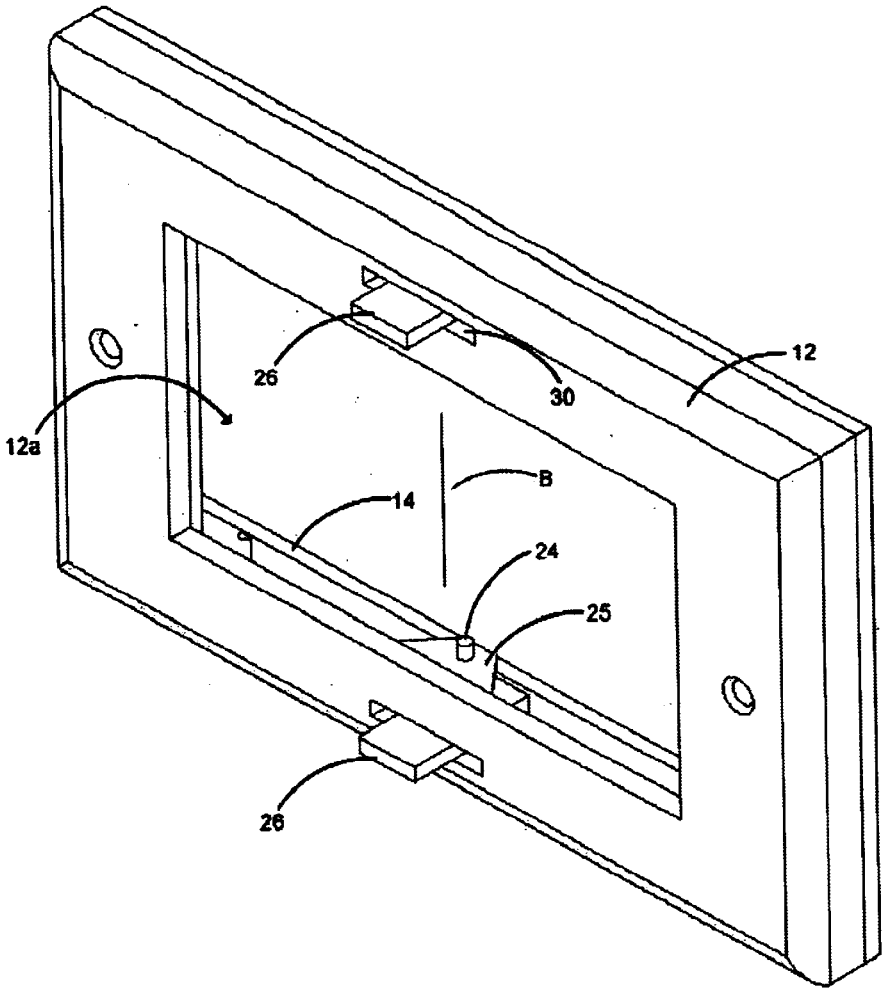
FIG. 3 is, in perspective view, the assembled device of FIG. 1, with the rocker plate removed.

Base 14 has an opening 14*a*. Cover 12 has a primary aperture 12*a* which aligns over opening 14*a*, when cover 12 is mounted over base 14, for example by screws (not shown) journalled through holes 12*b* so as to threadably engage a wall mounted electrical contact box (not shown). Lockout slide 18 includes first and second parallel interference bars 20*a* and 20*b* respectively which extend across opening 14*a* parallel to pivot axis B. A pair of parallel spaced apart elongate members 22 are rigidly mounted to the ends of interference bars 20*a* and 20*b* so as to form a rectangular frame framing therein a substantial portion of opening 14*a*. The distance D between interference bars 20*a* and 20*b* measured parallel to elongate members 22 exceeds the length of rocker plate 16 as measured from the distal end of first end 16a to the distal end of second end 16*b*. Consequently, when rocking plate 16 is pivotally mounted on cover 12, for example by means of stub shafts 24 as seen in FIG. 3 extending from flanges 25 in opposed facing relation engaging corresponding oppositely disposed holes in the sides 16*c* of rocker plate 16, and with cover 12 mounted onto base 14, rocker plate 16 may be pivoted about pivot axis B so as to elevate either first end 16*a* or second end 16*b* above the plane containing base 14. Rocker plate 16 may be rotated sufficiently, because the opposite ends of the rocker plate are formed in a flat V-shape so that with for example end 16*b* lowered into the plane E of base 14, the distal edge of end 16*a* is sufficiently elevated out of plane E so that interference bar 20*a* may be slid in direction C underneath end 16*a* thereby preventing end 16*a* of rocker plate 16 being depressed in direction A'. In this manner, the operation of rocker plate 16 is locked out. A user may operate the lockout by grasping or pushing on rigid buttons 26 which are rigidly mounted onto corresponding elongate members 22 for example medially along their length, so as to be disposed slidably between the opposite sides of corresponding guide channels 28 mounted onto base 14. Sliding buttons 26 in direction C" slides elongate members 22 and indeed the entire lockout slide 18 so that interference bar 20*a* translates in direction C' into a first lockout position underneath end 16*a* of rocker plate 16 thereby locking out the rocking function of the rocker switch.

Conversely, if it is desired to lockout end 16*b* when end 16*b* of rocker plate 16 is elevated and end 16*a* is lowered into plane E, with end 16*b* elevated button 26 is slid in a direction opposite to direction C" so as to slide lockout slide 18 in a direction opposite to direction C' thereby sliding interference bar 20*b* underneath the distal edge of end 16*b*.

Buttons 26 protrude upwardly from guide channels 28 through corresponding slots 30 which extend parallel to each other and perpendicular to pivot axis B along opposite sides of cover 12. The length of slots 30 constrain the distance buttons 26 may be slid and thereby constrain the travel of lockout slide 18 so that lockout slide 18 only travels in slide direction C and only may be slid a distance sufficient so that in the first lockout position interference bar 20*a* is slid underneath first end 16*a* of rocker plate 16, and in a second lockout position, second interference bar 20*b* may be slid under second end 16*b* of rocker plate 16, distance D being sufficiently long so that button 26 may be set in a neutral position midway along slots 30, and in that position, lockout slide 18 is positioned equidistance relative to pivot axis B and ends 16*a* and 16*b* of rocker plate 16 so that interference bars 20*a* and 20*b* are both outside of the arc of travel of ends 16*a* and 16*b* about pivot axis B allowing free rocking motion of rocker plate 16.

In one embodiment which is not intended to be limiting, a latch mechanism is provided so that lockout slide 18 may be releasably locked into either the first lockout position, the second lockout position, or a neutral position so as to not interfere with rocking or rocker plate 16. In one such embodiment, latch pins 32 are rigidly mounted to buttons 26 so as to extend therefrom into mating engagement with one of three notches 34 on each of guide channels 28. In FIGS. 1 and 2, pins 32 are shown engaging the notch 34 corresponding to the neutral position of lockout slide 18.

Lockout slide 18 is slidably mounted onto base 14 by the sliding engagement of the underside of elongate members 22 with rigid shims 36 rigidly mounted to base 14 so as to be sandwiched between base 14 and lockout slide 18. Shims 36 elevate lockout slide 18 out of plane E a sufficient distance so that when buttons 26 are depressed in direction F, elongate members 22 deflect allowing pins 32 to disengage beneath mating engagement in notches 34. Once pins 32 disengage from notches 34, buttons 26 may be slid along slots 30 so as to translate lockout slide 18 over shims 36 and relative to base 14.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A switch lockout for a rocker switch comprising:

a switch cover, a rocker plate having opposite first and second ends, said rocker plate pivotally mounted to said cover, said rocker plate pivotable about a pivot axis between oppositely tilted first and second tilted positions, a selectively translatable lockout slide and a base wherein said slide is slidably mounted on said base and wherein said first end of said rocker plate is spaced from said base when said rocker plate is in said first tilted position, and wherein said second end of said rocker plate is spaced from said base when said rocker plate is in said second tilted position, said lockout slide slidably mountable on said base for translation of said slide in a slide direction perpendicular to said pivot axis so as to slide relative to said rocker plate between a first lockout position and second lockout position, said lockout slide including oppositely disposed first and second interference bars, said interference bars slidable so as to sandwich said first interference bar between said first end of said rocker plate and said base when said lockout slide is in said first lockout position, and wherein said second interference bar is sandwiched between said second end of said rocker plate and said base when said lockout slide is in said second lockout position, said first interference bar thus protruding into a path of motion of said first end of said rocker plate when in said first lockout position and said second interference bar protruding into a path of motion of said second end of said rocker plate when in said second lockout position so that, in said first lockout position said first end of said rocker plate is selectively releasably locked into an elevated position relative to said base, and wherein in said second lockout position said second end of said rocker plate is selectively releasably locked into an elevated position relative to said base, said first and second interference bars spaced apart a distance greater than the length of said rocker plate between said first and second ends of said rocker plate, said lockout slide thus selectively translatable into either said first lockout position or said second said lockout position or a neutral position wherein neither said first nor said second interference bars are in said lockout positions and said rocker plate may be freely pivoted about said pivot axis.

2. The device of claim 1 wherein said lockout slide includes a pair of elongate members extending in said slide direction oppositely disposed on either side of said rocker plate, opposite ends of said pair of elongate members rigidly mounted to corresponding ends of said first and second interference bars.

3. The device of claim 2 wherein said base extends around a circumferential edge of said cover so as to extend along either side of said rocker plate, and wherein a pair of guides are mounted to said base oppositely disposed on either side of rocker plate so as to guide said elongate members when sliding in said slide direction.

4. The device of claim 3 wherein said cover has a primary aperture and said rocker plate is pivotally mounted in primary aperture, and wherein said cover has at least one slot therein adjacent said primary aperture and aligned both parallel to said slide direction and over a corresponding elongate member of said pair of elongate members when said cover is mounted on said base, and wherein at least one push button is mounted onto said corresponding elongate member so as to extend from said elongate member through said at least one slot, said slot elongate parallel to said slide direction so that biasing said at least one button along said at least one slot to an end of said at least one slot opposite from said first end of said rocker plate biases said first interference bar into said first lockout position, and conversely, biasing said at least one button along said at least one slot to an end of said at least one slot opposite from said second end of said rocker plate biases said second interference bar into said second lockout position.

5. The device of claim 4 wherein said at least one slot is a pair of slots oppositely disposed on either side of said primary aperture and wherein said at least one button is a pair of buttons mounted on said pair of elongate members so as to protrude through said pair of slots.

6. The device of claim 5 wherein said elongate members are elevated above said base by elevating means so as to elevate at least a portion of said elongate members adjacent said buttons above said base, and wherein said elongate members are resiliently deflectable where so elevated so that said buttons may be depressed to thereby release a selectively releasable latch means for locking said lockout slide in said first lockout position or said neutral position or said second lockout position so that said lockout slide may be selectively translated relative to said base.

7. The device of claim 6 wherein said elevating means are shim means mounted between said lockout slide and said base.

8. The device of claim 7 wherein said shim means are rigid shims mounted to said base.

9. The device of claim 8 wherein said shims are at least a pair of shims at opposite ends of each of said elongate members so as to elevate substantially the entire length of said elongate members above said base.

10. The device of claim 9 wherein said rocker plate is pivotally mounted to said cover by at least one shaft member extending from said cover into said primary aperture.

11. The device of claim 10 wherein said primary aperture is sized to snugly receive said rocker plate therein.

12. The device of claim 11 wherein said guides are channels, each having therein an array of notches, and wherein said latch means includes a pin extending from each said button so as to mate into a notch in said array of notches when said button is released and said elongate member urges said pin into engagement with a corresponding notch of said array of notches, and wherein depressing said button drives said pin from said notch as said elongate member deflects towards said base thereby allowing said sliding translation of said elongate member in said slide direction to align said pin with a different said notch in said array of notches.

* * * * *